United States Patent [19]

Eckerle

[11] 3,949,663

[45] Apr. 13, 1976

[54] MOUNTING MEANS FOR COMPACTOR REFUSE RECEPTACLE

[75] Inventor: William A. Eckerle, Louisville, Ky.

[73] Assignee: General Electric Company, Louisville, Ky.

[22] Filed: June 5, 1974

[21] Appl. No.: 476,528

[52] U.S. Cl. ..... 100/229 A; 16/114 A; 220/94 R; 294/31.2

[51] Int. Cl.[2] ..... B30B 15/00

[58] Field of Search ..... 220/94 R; 16/114 A, 125, 16/126, DIG. 25; 294/31.2; 248/223, 224, 73, 313; 100/229 A

[56] References Cited

UNITED STATES PATENTS

| | | | |
|---|---|---|---|
| 2,740,655 | 4/1956 | Maly | 294/31.2 |
| 3,654,855 | 4/1972 | Longo | 100/229 |

FOREIGN PATENTS OR APPLICATIONS

| | | | |
|---|---|---|---|
| 679,489 | 2/1964 | Canada | 248/224 |

*Primary Examiner*—Billy J. Wilhite

*Attorney, Agent, or Firm*—Robert W. Fletcher; Francis H. Boos

[57] ABSTRACT

A clamp means for disposition about the mouth of an open-topped refuse receptacle in a domestic compactor, the clamp means including a bail portion for carrying the receptacle when it is filled with trash and an over-center latch mechanism which secures the clamp tightly about the receptacle and insures that a plastic bag within the receptacle is not disturbed during the compacting cycle. Additionally, the clamp means includes a projection means which is received by a corresponding support means on the compactor door to prevent the receptacle from twisting during the compacting cycle.

4 Claims, 4 Drawing Figures

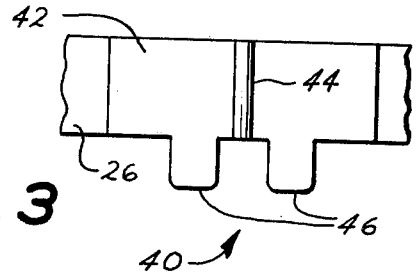
FIG. 3
FIG. 2
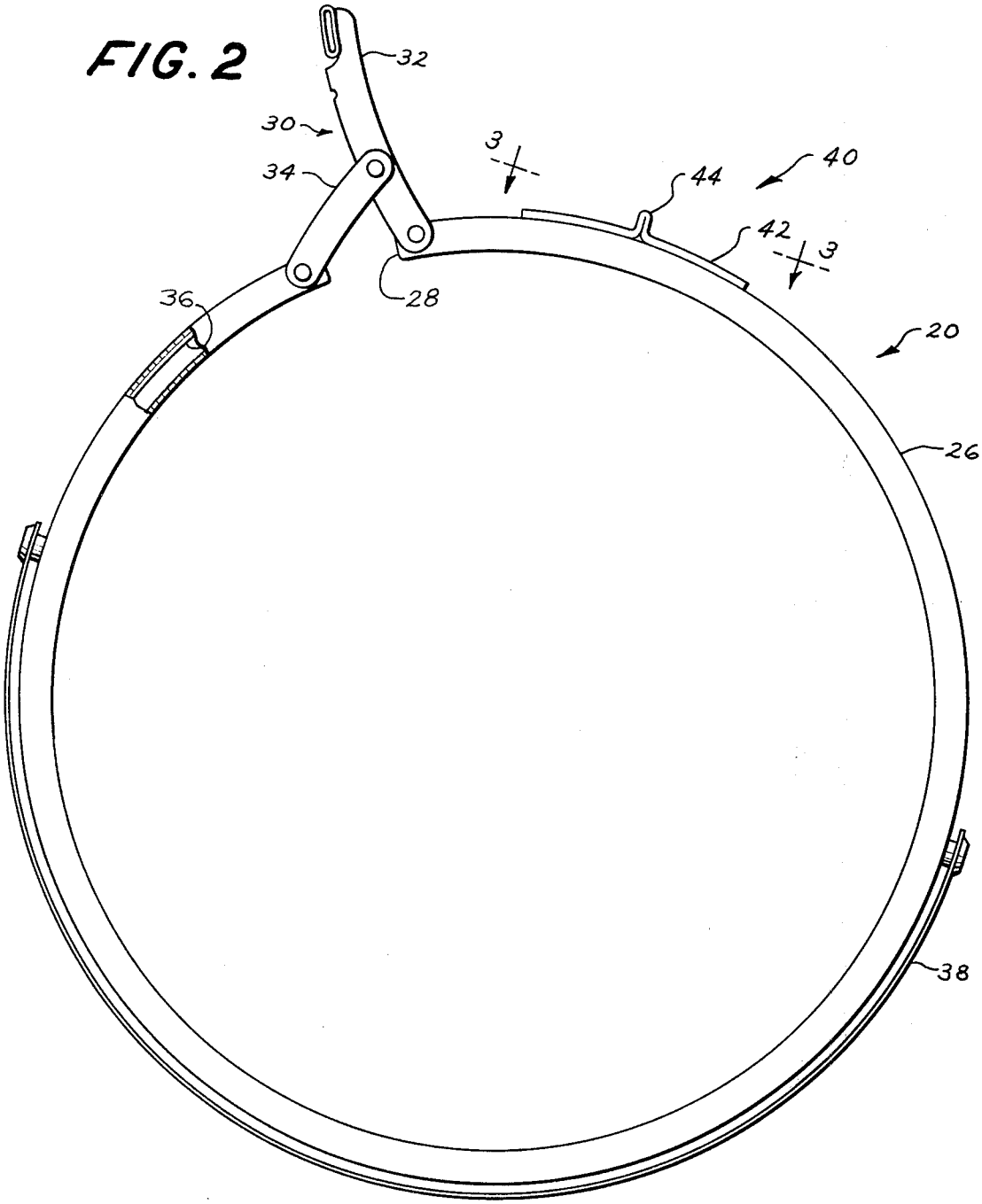

MOUNTING MEANS FOR COMPACTOR REFUSE RECEPTACLE

BACKGROUND OF THE INVENTION

Heretofore, domestic refuse compactors have been provided which are of a design that includes drawer means for receiving refuse to be compacted. Such compactors have suffered from the disadvantage that the drawer is not removable from the cabinet and thus refuse compacted within the drawer must somehow be removed. Provision of a flexible bag, such as suggested in U.S. Pat. No. 3,443,745, has proven to be ineffectual since generally such bags are not of sufficient strength to allow lifting of compacted refuse from a drawer. The use of a support sling within such a drawer has similarly proven to be ineffectual since generally such slings are cumbersome to use and difficult to store. The optimum is to provide a refuse compactor having a refuse receptacle which is easily removed when it becomes full. To this end, the present invention includes a refuse receptacle which is easily removed from its support position on the compactor door and which includes provision for holding a plastic bag within the receptacle container yet obviates the need for the bag to serve as a carrying means for the compacted refuse.

SUMMARY OF THE INVENTION

The invention of this disclosure includes clamp means adapted to be secured to the mouth of an open-topped refuse container to provide handle means for carrying the container, detachable fastening means for holding the container in a mounted position with respect to the compactor door and over-center latch means for easily removing the clamp after the receptacle has been carried to a central disposal point. The clamp further provides reinforcement for the upper portion of the container during the compacting cycle and thereby prevents the container from rupturing along its longitudinal axis. More specifically, the invention includes a refuse compactor comprising a frame having first and second spaced sides and an open front defining a refuse compacting chamber, a door mounted for movement between positions opening and closing the access opening, means for holding an open-topped container within the chamber and means for vertically reciprocating a pressure plate into and out of the container for compressing refuse therein, said means for holding said open-topped container within the chamber including clamp means encircling the open-topped container and having attached thereto a bail for carrying the container; an over-center latch mechanism to secure the clamp means to the mouth of the container and a mounting member receivable by corresponding means on the door of said compactor. The clamp means of this invention has been found to be a useful apparatus for successfully employing an open-topped, removable, cylindrical container in a domestic refuse compactor.

DESCRIPTION OF THE DRAWINGS

FIG. 2 is a plan view of the clamp means of this invention; and

FIG. 3 is a view taken along lines 3—3 in FIG. 2.

DESCRIPTION OF THE PREFERRED EMBODIMENT

Figure 1:
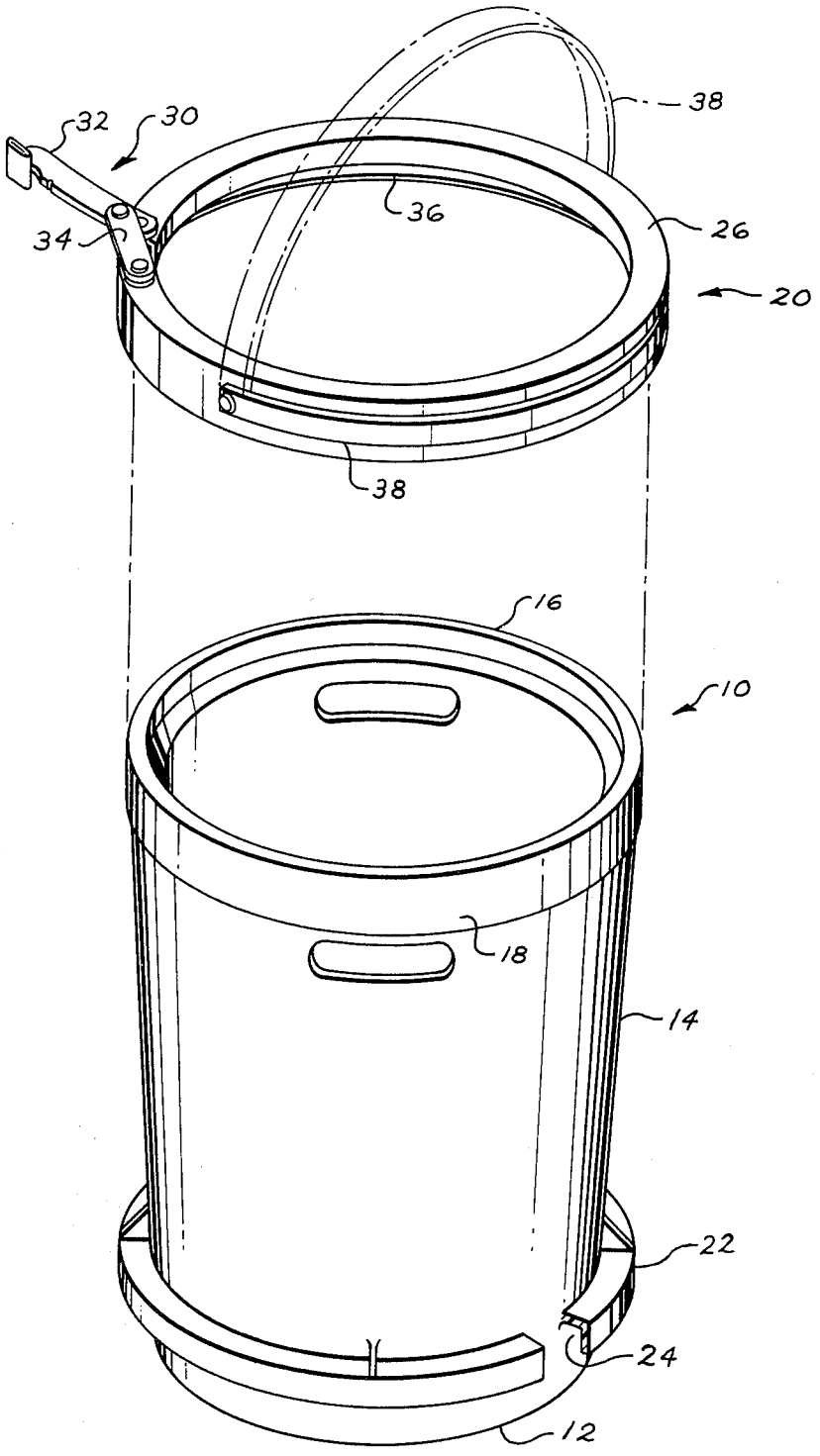
FIG. 1 is an exploded, isometric view of a cylindrical container and the clamp means of this invention.
Figure 4:
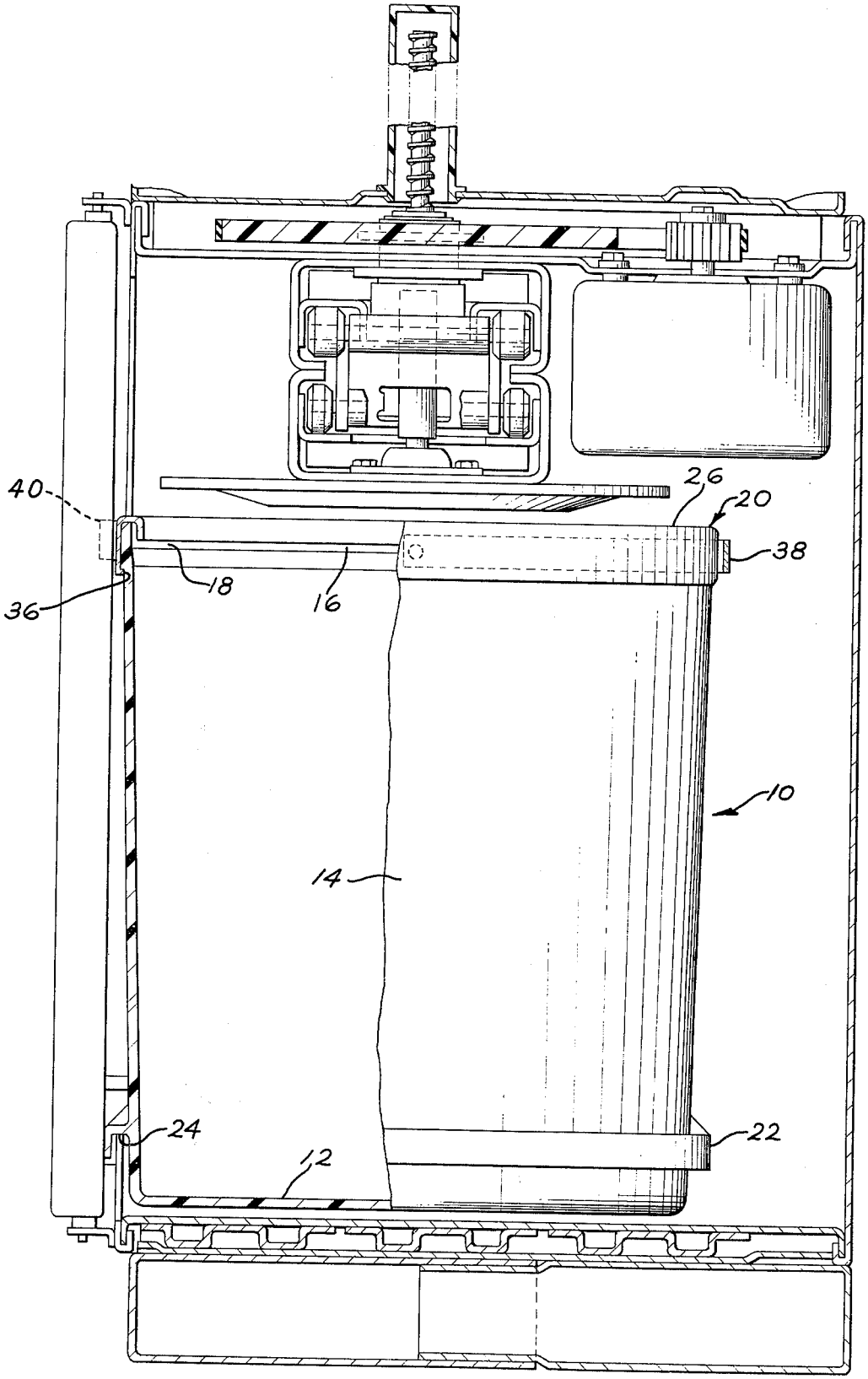

FIG. 1 shows a container 10 preferably of onepiece, polymeric, resinous material substantially cylindrical in shape. Container 10 may be tapered slightly in order to facilitate molding thereof. Container 10 provides a bottom wall 12, an arcuate closed side wall 14, and an open top 16. A circumferential stiffening rib 18 may be provided to give additional strength to the mouth of container 10 and provide attaching means to engage clamp means 20. A bracket 22 integral with the side wall 14 conveniently extends circumferentially about the container 10 providing a groove 24 for receiving a corresponding channel member of a mounting means attached to the compactor door (not shown), thereby supporting the container 10 at its lower end. Surrounding the open top 16 of the container 10 is clamp means 20 which serves a number of functions including clamping a flexible bag (not shown) in refuse receiving position within the container; providing support for the container against downward and twisting movement; providing increased circumferential strength for container 10 adjacent the open top thereof and providing a handle means for lifting container 10 out of load receiving position on the compactor door.

Clamp means 20 comprises a ring member 26 of generally U-shaped cross-section for receiving the open top 16 of container 10. The ring member 26 is made of a resilient material, typically steel, aluminum or other suitable metal, and includes an open gap 28 in the circumference thereof. An over-center latch means 30 spans the gap 28 and facilitates tightening of the clamp onto the container. It also allows loosening of the clamp when it is desired to remove the bag from the container. The over-center latch 30 may be of any suitable design and is illustrated as including an elongate handle 32, pivotally mounted onto the ring 26 on one side of the gap 28, and a link 34 connected to the other side of the gap 28 and pivotally connected to handle 32 thus spanning the gap 28. Rotation of handle 32 in a clockwise direction, as viewed in FIG. 2, causes the gap 28 to be closed, thereby securing the clamp onto container 10. Ring member 26 additionally includes an inturned flange portion 36 which is adapted to interlock beneath the lower edge of stiffening rib 18 and thus prevent clamp means 20 from being pulled off of container 10 when the clamp is being used as part of a lifting arrangement.

In this regard, clamp 20 includes a semi-circular bail 38 which is pivotally attached at points diametrically opposite each other on the side wall of ring member 26. Bail 38 may be swung into an upright position and used to lift container 10 off the mounting means mounting it to the compactor door when it is desired to dispose of the compacted refuse contained therein. It should be noted that bail 38 is preselectively located opposite gap 28 and opposite mounting member 40, such that when bail 38 is in its stored or horizontal position it will not interfere with easy manipulation of the container 10 into and out of the compactor.

In this regard, mounting member 40 is adapted to cooperate with mounting means (not shown) attached to the compactor door to facilitate attaching container 10 to the door. Mounting member 40 includes arcuate section 42, secured as by welding or the like to the side wall of ring member 26, and further includes projection 44 which is adapted to be received in the slot provided by the door mounting means. The arcuate section 42 also includes a pair of depending legs 46 for receipt in the door mounting means. Generally, the projection 44 prevents twisting movement of the container 10 during compacting while the legs 46 prevent the container from tilting away from the mounting means and assists in providing a vertical support for the container mounted to the compactor door.

In use, a plastic bag is inserted into container 10 with the top portion folded downwardly overlapping the open mouth 16. Clamp 20 is then positioned on top of the container with the plastic bag sandwiched therebetween. Handle 32 is then rotated in a clockwise direction, as viewed from above in FIG. 2, closing open gap 28 and causing ledge 36 to engage the underside of stiffening rib 18. Bail 38 is then pivoted to an upright position and the container and clamp are carried as a unit to the compactor. The compactor door is opened and container 10 is lowered adjacent thereto such that groove 24 engages a corresponding member extending interiorly of the door and, simultaneously, legs 46 and projection 44 are lowered into corresponding members at the upper end of the door, thus attaching container 10 to the door. This having been done, bail 38 is pivoted to its horizontal or rest position. The container is now ready to have refuse deposited therein and in alternating, successive operations have the refuse compacted and additional refuse added until the container is filled with compacted refuse.

When the container is full, the door is opened and bail 38 is pivoted to its upright position. The container is then lifted via bail and clamp means 20 from its mounting means on the door and is carried to a central depository or trash can. To remove clamp means 20, handle 32 is rotated in a counterclockwise direction and ledge 36 is dislodged from its gripping relationship with stiffening rib 18. Clamp means 20 is then removed from container 10 and the plastic bag is twisted shut at its top. Container 10 is then tipped on its side and gently rolled in a rocking motion with one hand while the top of the plastic bag is maintained closed and a gentle moving force is exerted thereon; thus the plastic bag containing the compacted refuse is easily removed from the container and is now ready to be disposed of.

It can be seen that in employing this invention it is not necessary to use a plastic bag liner in the container 10. If such a bag is not used, clamp means 20 need not be removed each time the container is emptied, but rather only removed to effect complete removal of small particles entrapped between the container and clamp means and to wash the container.

Having thus described the invention, what is claimed is:

1. In a refuse compactor comprising a frame having first and second spaced sides and an open front defining a refuse compacting chamber;

a door mounted for movement between positions opening and closing the open front;

means for holding an open-topped container within the chamber; and means for vertically reciprocating a pressure plate into and out of the container for compressing refuse therein;

the improvement being that said means for holding said open-topped container within the chamber includes clamp means, encircling said open-topped container, said clamp means having: (a) a ring including an expansion gap and an inturned flange portion configured to interlock with a corresponding receiving means on said container to prevent said clamp means from being pulled off of said container during lifting thereof, (b) a bail attached to said ring for carrying the container, (c) an overcenter latch mechanism including an elongate handle pivotally mounted to said ring on one side of said gap and a link connected to the other side of said gap and pivotally connected to said handle thus spanning said gap such that rotation of said handle opens and closes said gap to thereby release or secure the clamp with respect to said container, and (d) a mounting member integrally attached to said ring and receivable by corresponding means on the door of said compactor, thereby providing means for mounting said container to said door, said clamp means providing support for said container against downward and twisting movement during the compacting cycle of said compactor, providing increased circumferential strength for said container adjacent the open top thereof and providing a bail means for lifting said container out of load receiving position on said compactor door.

2. The apparatus of claim 1 wherein said bail is a semi-circular member pivotally attached at points diametrically opposite each other on the periphery of said clamp means.

3. The apparatus of claim 1 wherein said mounting member includes spaced apart arcuate wings terminating in projections which are received by corresponding portions on said compactor door to support the top portion of said container.

4. The apparatus of claim 3 wherein said mounting member further includes a projection attached thereto to be received by a corresponding means on said compactor to prevent twisting of said container during compacting.

* * * * *